US010669743B2

(12) United States Patent
Fustini et al.

(10) Patent No.: US 10,669,743 B2
(45) **Date of Patent: *Jun. 2, 2020**

(54) CYLINDER LOCK AND ASSOCIATED KEY

(71) Applicant: CISA S.P.A., Faenza (IT)

(72) Inventors: Fausto Fustini, Imola (IT); Enzo Talamonti, Ascoli Piceno (IT)

(73) Assignee: CISA S.P.A., Faenza (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/227,963

(22) Filed: Dec. 20, 2018

(65) Prior Publication Data

US 2019/0218822 A1 Jul. 18, 2019

Related U.S. Application Data

(63) Continuation of application No. 15/031,867, filed as application No. PCT/IT2013/000297 on Oct. 25, 2013, now Pat. No. 10,161,163.

(51) Int. Cl.
*E05B 27/00* (2006.01)
*E05B 35/00* (2006.01)
(Continued)

(52) U.S. Cl.
CPC ..... *E05B 35/003* (2013.01); *E05B 19/0064* (2013.01); *E05B 27/0017* (2013.01);
(Continued)

(58) Field of Classification Search
CPC ..... E05B 35/008; E05B 27/0057; E05B 19/0064; E05B 27/0017; E05B 27/0042;
(Continued)

(56) References Cited

U.S. PATENT DOCUMENTS 4,667,495 A 5/1987 Girard et al.
5,170,651 A 12/1992 Errani
(Continued)

FOREIGN PATENT DOCUMENTS

EP 1121502 A1 8/2001
WO 00/22263 * 4/2000
WO 2009147660 A2 12/2009

OTHER PUBLICATIONS

International Search Report; European Patent Office; International Application No. PCT/IT2013/000297; dated Jul. 28, 2014; 3 pages.
(Continued)

*Primary Examiner* — Lloyd A Gall
(74) *Attorney, Agent, or Firm* — Taft Stettinius & Hollister LLP

(57) ABSTRACT

A cylinder lock and an associated key, the lock including a fixed body and a plug which is accommodated within a respective cavity of the body and can rotate with respect to the body. The plug includes a substantially longitudinal compartment for the functional accommodation of a key which includes a grip portion from which an elongated body extends and which is provided with coding grooves and protrusions on its outer surface. Between the plug and the body are respective accommodation channels for translating coding elements, which open onto the substantially longitudinal compartment. The plug includes at least one auxiliary duct which faces the substantially longitudinal compartment and extends at least partially in the body for the sliding accommodation of at least one coding unit that includes at least one pin and at least one conical portion.

20 Claims, 4 Drawing Sheets

(51) Int. Cl.
*E05B 19/00* (2006.01)
*E05B 27/10* (2006.01)

(52) U.S. Cl.
CPC ..... *E05B 27/0021* (2013.01); *E05B 27/0042* (2013.01); *E05B 27/0057* (2013.01); *E05B 2027/10* (2013.01)

(58) Field of Classification Search
CPC ..... E05B 2027/10; E05B 19/0017; E05B 19/0035; E05B 19/0058; E05B 33/00; E05B 35/003; E05B 27/0021; E05B 35/004; E05B 35/005; E05B 27/0096; E05B 19/18; Y10T 70/7605; Y10T 70/7802; Y10T 70/7819; Y10T 70/7881
USPC ..... 70/359, 409, 493, 395, 398, 419, 421, 70/399
See application file for complete search history.

(56) References Cited

U.S. PATENT DOCUMENTS

| | | | | |
|---|---|---|---|---|
| 5,457,974 | A | 10/1995 | Keller | |
| 5,520,035 | A | 5/1996 | Eizen et al. | |
| 6,508,091 | B1 | 1/2003 | Donatini | |
| 9,103,139 | B2 | 8/2015 | Clifford | |
| 10,161,163 | B2 * | 12/2018 | Fustini | E05B 27/0021 |
| 2009/0113965 | A1 | 5/2009 | Weinberger | |
| 2012/0055212 | A1 | 3/2012 | Nicoara | |

OTHER PUBLICATIONS

Written Opinion of the International Searching Authority; European Patent Office; International Application No. PCT/IT2013/000297; dated Jul. 28, 2014; 6 pages.

* cited by examiner

CYLINDER LOCK AND ASSOCIATED KEY

CROSS REFERENCE TO RELATED APPLICATIONS

This application is a continuation of U.S. application Ser. No. 15/031,867 filed on Apr. 25, 2016 and issued as U.S. Pat. No. 10,161,163, which is a U.S. national stage filing of International Application No. PCT/IT2013/000297 filed on Oct. 25, 2013, the contents of each application hereby incorporated by reference in their entirety.

TECHNICAL FIELD

The present invention relates to a cylinder lock and to the associated key.

BACKGROUND

Cylinder locks and respective keys are known whose characteristics are described in EP1121502 (priority, Italian application no. B098A000586 filed on Oct. 15, 1998) in the name of this same Applicant. This document describes a cylinder lock whose code cannot be deciphered immediately from the outside, so as to hinder tampering therewith.

This result is obtained by arranging at least one tumbler at right angles to the keyway in the plug of the cylinder, said tumbler having a respective end that protrudes into said keyway.

The tumbler is associated with respective complementary tumblers that can translate elastically from a configuration in which they are fully accommodated within the plug to at least one configuration for simultaneous accommodation in the body and in the plug, with consequent coupling of these two parts.

The key has a movable pad, which is forced elastically into conditions of substantially co-planar arrangement with a respective surface of the key and is accommodated so that it can slide within a respective seat.

When the key is inserted in the keyway, it actuates the tumblers, arranging them so that the complementary tumblers are in the configuration in which they are fully accommodated within the body, allowing any movement of the plug following a rotation of said key.

The presence of the movable pad in the key, associated with the at least one tumbler, ensures higher security of the lock with respect to break-in actions generically known as picking (mechanical tampering).

The tumbler that acts on the movable pad is in fact constituted by an actual tumbler provided with an end stem, which engages in a complementary tumbler provided with a cavity whose shape and dimensions are complementary to those of the stem. Appropriate elastic means are arranged between the tumbler and the complementary tumbler and are intended to keep them at the maximum mutual distance.

When the lower end of the tumbler abuts against the movable pad, a compression of the elastic element arranged between the movable pad and its seat in the key is induced. The elastic action of the elastic element controlled by the pad is stronger than that of the elastic means interposed between the tumbler and the complementary tumbler, causing a compression thereof.

In practice, movement of the plug is possible only when the respective key is inserted correctly within the keyway of the lock, in order to release the at least one perpendicular tumbler provided with said elastic means.

Unfortunately, it has been observed that it is possible to break into this type of lock by using keys provided with holes at the seat that should accommodate the movable pad.

These holes can, for break-in purposes, be filled with elastically deformable material. The gradual insertion of said material into the hole, with consequent repeated attempts to open the lock, allows identifying the amount of elastically deformable material that is necessary to emulate the original key, making it possible to open the lock.

SUMMARY

The aim of the present invention is to solve the problems described above, providing a cylinder lock that is complicated to break into.

Within this aim, an object of the invention is to propose a key that is difficult to emulate.

Another object of the invention is to provide a cylinder block and an associated key that are difficult to attack with break-in methods of the known type.

A further object of the present invention is to provide a cylinder lock and an associated key that have relatively low costs and are relatively simple to provide in practice and safe in application.

This aim and these objects are achieved by a cylinder lock of the type comprising a fixed body and a plug, which is accommodated within a respective cavity of said body and can rotate with respect to said body, said plug comprising a substantially longitudinal compartment for the functional accommodation of a respective key, between said plug and said body respective accommodation channels for translating coding elements being provided, said channels being open onto said substantially longitudinal compartment, characterized in that said plug comprises at least one auxiliary duct, which faces said substantially longitudinal compartment and extends at least partially into said body, for the sliding accommodation of at least one coding unit that is constituted by at least one pin and at least one conical portion, said conical portion being fitted at least partially on a first end of said pin, axially acting elastic means being able to be interposed between said pin and said conical portion, the second end of said pin, which faces said substantially longitudinal compartment, having dimensions and shapes that are complementary to those of the head of a movable pad of a respective key, against which it abuts in the configuration for use.

This aim and these objects are also achieved by means of a key of the type comprising a grip portion from which an elongated body extends which is provided with coding grooves and protrusions on its outer surface, characterized in that it comprises at least one accommodation recess for a movable pad, elastic elements for mutual spacing being able to be interposed between the bottom of said recess and the base of said movable pad, the head of said movable pad comprising a depression whose shape and dimensions are complementary to those of the outermost front of a coding unit of a cylinder lock, in the configuration for use said outermost front of said coding unit being accommodated at least partially within said depression.

This aim and these objects are achieved by means of a cylinder lock and an associated key, said lock being of the type comprising a fixed body and a plug, which is accommodated within a respective cavity of said stator and can rotate with respect to said body, said plug comprising a substantially longitudinal compartment for the functional accommodation of a key which comprises a grip portion from which an elongated body extends which is provided with coding grooves and protrusions on its outer surface, respective accommodation channels for translating coding elements being provided between said plug and said body, said channels being open onto said substantially longitudinal compartment, characterized in that said plug comprises at least one auxiliary duct, which faces said substantially longitudinal compartment and extends at least partially within said body, for the sliding accommodation of at least one coding unit constituted by at least one pin and at least one conical portion, said conical portion being fitted at least partially on a first end of said pin, axially acting elastic means being able to be interposed between said pin and said conical portion, the second end of said pin, which faces said substantially longitudinal compartment, having a shape and dimensions that are complementary to those of a depression of the head of a movable pad, which is accommodated elastically within a recess of said key, against which it abuts in the configuration for use, being accommodated at least partially within said depression in the configuration for use.

BRIEF DESCRIPTION OF THE FIGURES

Further characteristics and advantages of the invention will become more apparent from the description of a preferred but not exclusive embodiment of the cylinder lock and associated key according to the invention, illustrated by way of non-limiting example in the accompanying drawings, wherein.

DETAILED DESCRIPTION OF ILLUSTRATIVE EMBODIMENTS

Figure 1:
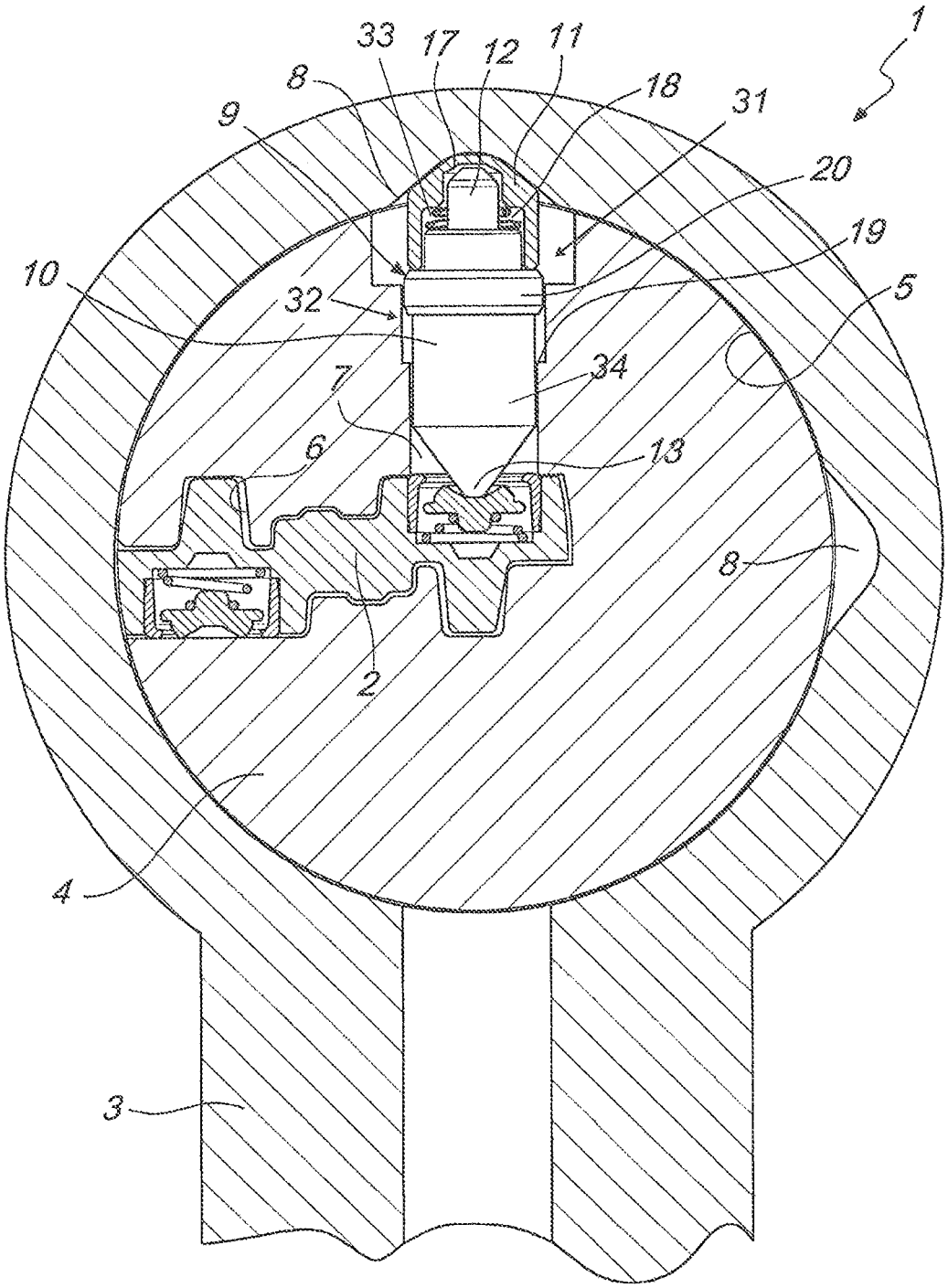
FIG. 1 is a sectional front view, taken along a transverse plane, of a cylinder lock with associated key according to the invention.
Figure 2:
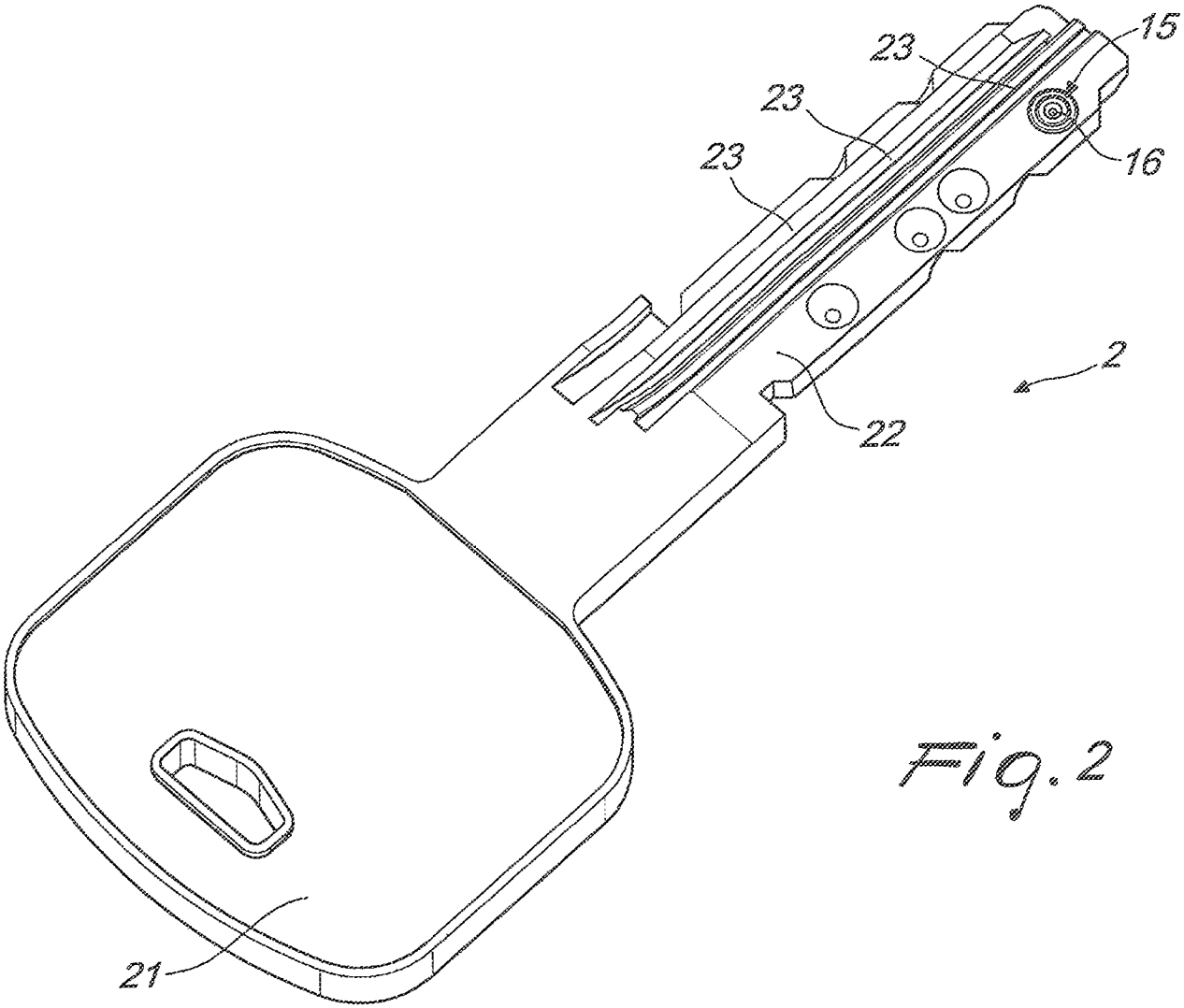
FIG. 2 is a perspective view of a key according to the invention.
Figure 3:
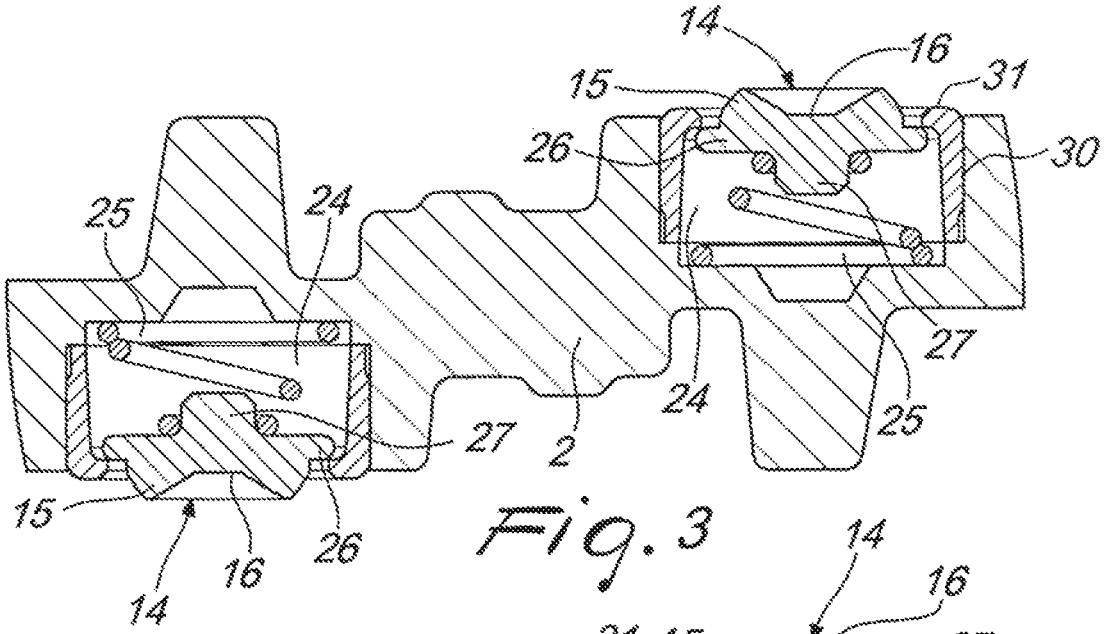
FIG. 3 is a sectional view, taken along a transverse plane, of a first constructive solution for a key according to the invention.
Figure 4:
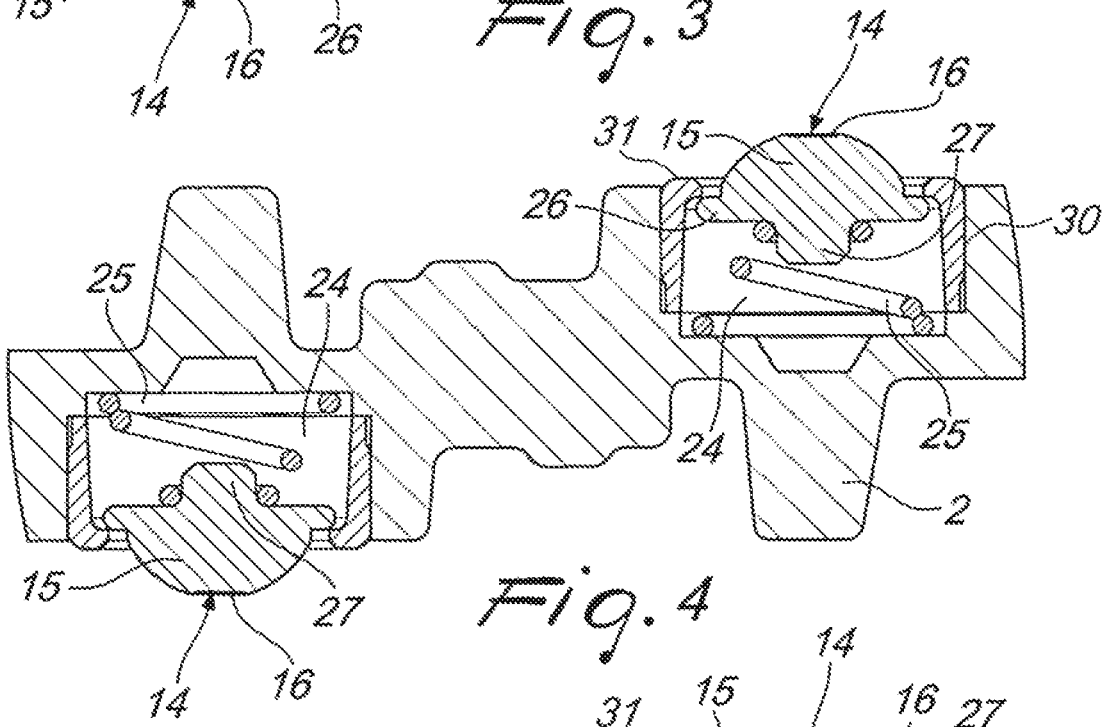
FIG. 4 is a sectional view, taken along a transverse plane, of a second constructive solution for a key according to the invention.
Figure 5:
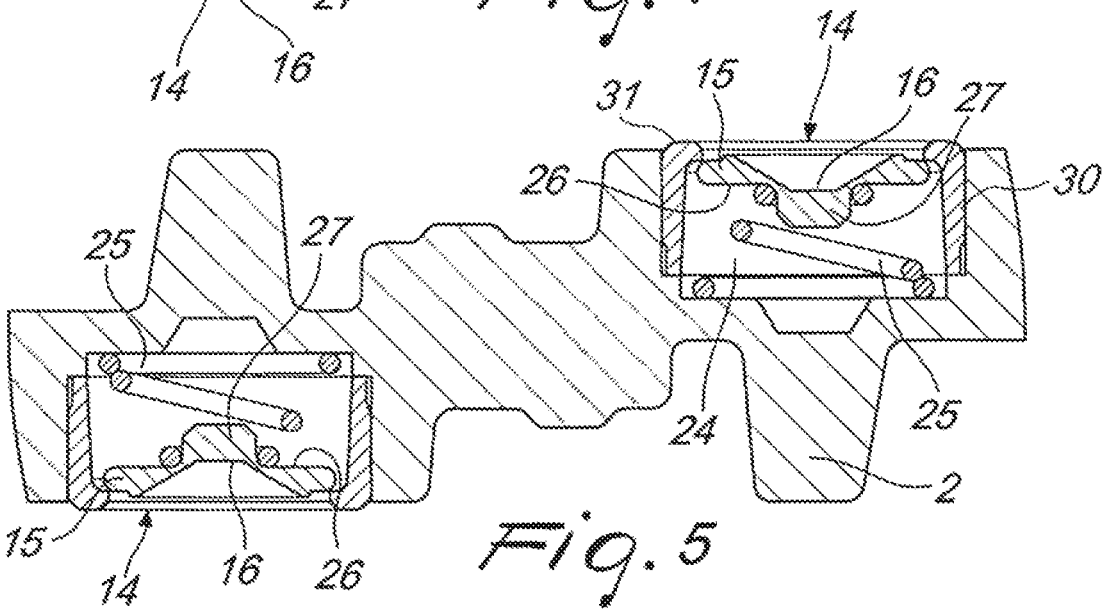
FIG. 5 is a sectional view, taken along a transverse plane, of a third constructive solution for a key according to the invention.
Figure 6:
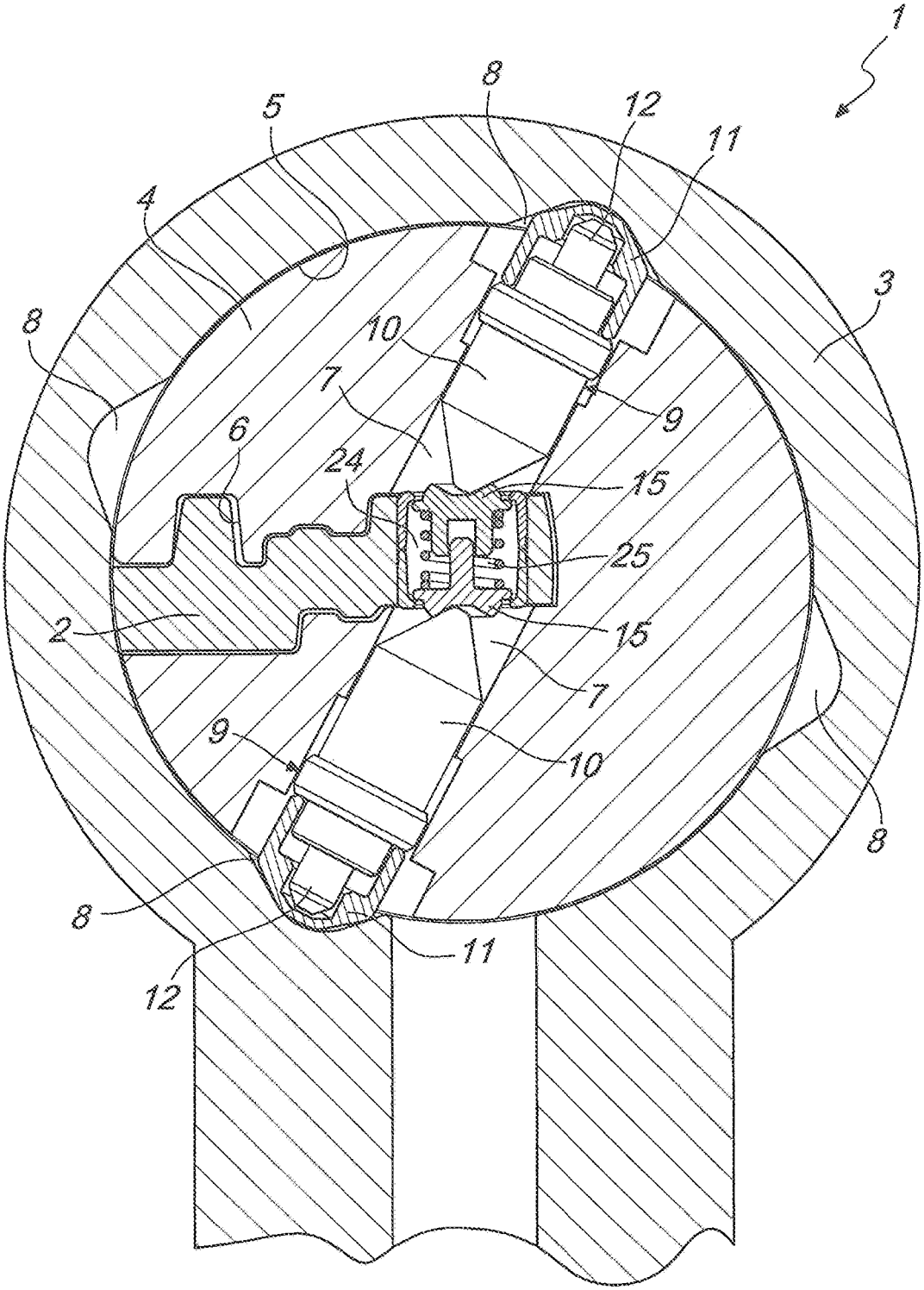
FIG. 6 is a sectional front view, taken along a transverse plane, of a possible variation of a cylinder lock with associated key according to the invention.

With particular reference to the figures cited above, the reference numeral 1 designates generally a cylinder lock and the numeral 2 designates an associated key.

The cylinder lock 1 comprises a fixed body 3 and a plug 4, which is accommodated within a respective cavity 5 of the body 3.

The plug 4 can rotate with respect to the body 3 and comprises a substantially longitudinal compartment 6 for the functional accommodation of a respective key 2.

Respective accommodation channels for translating coding elements are present between the plug 4 and the body 3. The channels are open onto the substantially longitudinal compartment 6 in order to allow the translating coding elements to rest against the corresponding key portion 2. For example, the accommodation channel 31 illustrated in FIG. 1 includes an auxiliary duct 7 and a recess 8, and allows a translating coding element 32 in the form of a coding unit 9 to rest against a movable pad 15 of the corresponding key portion 2.

The plug 4 comprises at least one auxiliary duct 7, which faces the substantially longitudinal compartment 6 and extends at least partially within the body 3. In particular, said duct 7 extends into a recess 8 that is provided with mutually opposite inclined surfaces and has its maximum depth at the portion that is aligned with the auxiliary duct, when said duct is in the inactive configuration and the plug 4 has not undergone any rotation with respect to the body 3.

The duct 7 and the recess 8 slidingly accommodate at least one coding unit 9 that is constituted by at least one pin 10 and at least one conical portion.

The conical portion 11 is at least partially fitted on a first end 12 of the pin 10.

Axially acting elastic means 33 are interposed between the pin 10 and the conical portion 11.

The second end 13 of the pin 10, which faces the substantially longitudinal compartment 6, has a shape and dimensions that are complementary to those of the head 14 of a movable pad 15 of a respective key 2.

In other words, the second end 13 is shaped (at least in its front portion) like the head 14 of the movable pad 15 against which it abuts in the configuration for use (i.e., when the key 2 is inserted in the compartment 6).

According to a specific constructive solution of unquestionable interest in application, the second end 13 of the pin 10 is tapered toward its terminal edge. The terminal face of said second end 13 has a shape that is complementary to the shape of a depression 16 that is provided in the top of the head 14 of the movable pad 15 of the key 2 in order to accommodate the second end 13 in said depression 16.

In this manner, the coding unit 9 (constituted in this specific case by the pin 10 and the conical portion 11) can assume a position that is suitable to allow the rotation of the plug 4 with respect to the body 3 only when the second end 13 is inserted within the depression 16.

Of course, if one uses a key whose depression 16 does not have a specific shape (a shape which is complementary to that of the terminal front of the end 13), if one uses a key that is different from the key 2 intended to open the cylinder lock 1, the coding unit 9 cannot assume a position in which it is accommodated completely within the plug 4 (protruding partly within the recess 8 and thus interfering with the plug 3). In these conditions, therefore, it is not possible to induce any rotation of the plug 4 within the body 3, and therefore it is not possible to open the lock 1.

In order to optimize the operation of the lock 1 according to the invention, also increasing its security against any break-in attempts, the pin 10 can comprise a first end 12 that has a low thickness and is suitable to be accommodated partially in a respective hollow 17 of the bottom of the internal cavity 18 of the conical portion 11.

The pin 10 comprises furthermore at least one central portion 34 whose thickness is close to the diameter of the auxiliary duct 7.

Any insertion in the compartment 6 of a key that has a very deep hole (in relation to the thickness of said key) instead of the movable pad 15 that is present on the key 2 associated with the lock 1, said hole being such as to accommodate the end 13 completely, would cause the complete accommodation of the pin 10 within the auxiliary duct 7.

The particular shape of the cavity 18 of the conical portion 11 and the possibility of interposing elastic means intended to mutually space the end 12 of the pin 10 from the seat 17 in any case cause the conical portion 11 to remain within the recess 8, with the second end 12 of the pin 10 engaging in a portion that has a larger diameter than the hollow 17 of the cavity 18. Therefore, even by using a key provided with a hole adapted to accommodate completely the second end 13 of the pin 10 it is not possible to rotate the plug 4 with respect to the body 3.

It has been found, therefore, that the lock 1 is particularly secure against break-in attempts, since it cannot be opened with forged keys, both if they comprise a pad (not shaped appropriately at the depression 16 of the head 14) or if they have a hole suitable to accommodate completely the second end 13 of the pin 10.

Moreover, it is specified that the auxiliary duct 7 can comprise preferably a portion having a large diameter, which is arranged proximate to the outer surface of the plug 4 and faces the body 3.

It may comprise, furthermore, at least one additional portion having a smaller diameter/width and provided with at least one shoulder 19 for a protruding rim 20 of the pin 10.

In this manner it is observed that the pin 10 can translate within the duct 7 from a first configuration, in which its first end 12 is accommodated completely and rests within the hollow 17 of the conical portion 11, which in turn is accommodated completely in the recess 8, to a second configuration, in which its protruding rim 20 rests against the shoulder 19 of the duct 7 (and the second end 12 is outside the hollow 17, although it is always contained in the cavity 18 of the conical portion 11).

In the second configuration, the retention of the conical portion 11 within the recess 8 can be ensured by the interposition of axially acting elastic means between the pin 10 and the conical portion 11 itself.

It is specified that according to a constructive solution of unquestionable practical interest and with high security against break-in, the auxiliary ducts 7 may also be two (or more), substantially mutually opposite (if there are more than two, they are mutually opposite in corresponding pairs), and each accommodating at least one respective coding unit 9, provided with at least one respective pin 10 the end 13 of which leads to the substantially longitudinal compartment 6.

In the configuration for use, each end 13 of each pair of pins 10 abuts against a respective head 14 of a corresponding movable pad 15 of a corresponding key 2 (in this case, the key 2 can comprise preferably two mutually opposite pads and/or a channel within which a single pad provided with two mutually opposite heads can translate, each head being surmounted by a respective depression 16).

The present invention relates also to a key 2 that comprises a grip portion 21 from which an elongated body 22 protrudes which is provided with coding grooves and protrusions 23 on its outer surface.

The key 2 comprises at least one recess 24 for accommodating a movable pad 15.

Elastic elements 25 for mutual spacing are preferably interposed between the bottom of the recess 24 and the base of the movable pad 15.

The head 14 of the movable pad 15 comprises a depression 16 whose shape and dimensions are complementary to those of the outermost front of a coding unit 9 of a cylinder lock 1.

In the configuration for use, the outermost front of the coding unit 9 is accommodated at least partially within the depression 16, pushing the pad 15 toward the bottom of the recess 24 upon a rotation of the key 2 inserted in the plug 4 of the lock 1.

The pad 15 can have preferably a substantially disk-like shape. Its base 26 comprises a centering protrusion 27 for the alignment and coupling of the pad 15 with the elastic elements 25.

The head 14 of the pad 15 comprising the depression 16 is preferably convex. The depression 16 in this case is constituted by a concavity that is arranged substantially in the top of said convex head 14.

As an alternative, the head 14 of the pad 15 can be substantially flat. In this case, the depression 16 is arranged substantially in the central region of the flat head 14.

It is specified that the scope of protection of the present invention also extends to the assembly constituted by a cylinder lock 1 and the associated key 2.

The lock 1 in this case is of the type that comprises a fixed body 3 and a plug 4 that is accommodated within a respective cavity 5 of the body 3 and can rotate with respect to said body 3.

The plug 4 comprises a substantially longitudinal compartment 6 for the functional accommodation of the key 2, which in turn comprises a grip portion 21 from which an elongated body 22 protrudes which is provided with coding slots and protrusions 23 on its outer surface.

Respective accommodation channels for translating coding elements are present between the plug 4 and the body 3 and are open onto the substantially longitudinal compartment 6.

The plug 4 comprises at least one auxiliary duct 7, which faces the substantially longitudinal compartment 6 that extends at least partially within the body 3, for the sliding accommodation of at least one coding unit 9 constituted by at least one pin 10 and at least one conical portion 11.

The conical portion 11 is at least partially fitted on a first end 12 of the pin 10. Between the pin 10 and the conical portion 11, it is possible to interpose axially acting elastic means intended to force them mutually apart.

The second end 13 of the pin 10, which faces the substantially longitudinal compartment 6, has a shape and dimensions that are complementary to those of a depression 16 of the head 14 of a movable pad 15, which is accommodated elastically within a recess 24 of the key 2.

Said second end 13 abuts against said depression 16 in the configuration for use (i.e., when the key 2 is inserted in the compartment 6 to open/close the lock 1), being at least partially accommodated within said depression 16.

The coding unit 9, as already described earlier, comprises in this case also at least one pin 10 and at least one conical portion 11, and a second end 13 of the pin 10 is tapered toward its terminal edge.

The first end 12 of the pin 10 is instead inserted within the conical portion 11.

It is specified that the terminal face of the second end 13 has a shape that is complementary to that of the depression 16 that is present in the top of the head 14 of the movable pad 15 of the key 2 so that it can be accommodated in said depression 16 in the configuration for use.

It is specified that according to a particular constructive solution that is of unquestionable interest in practice and in application as well as highly secure against break-ins, the auxiliary ducts 7 are two in number and are substantially mutually opposite and each one accommodates at least one respective coding unit 9 provided with at least one respective pin 10 the end of which leads to the substantially longitudinal compartment 6.

In the configuration for use, each pin 10 has a respective second end 13 that abuts against a respective head 14 of a corresponding movable pad 15 of the key 2.

Obviously, in this case the key 2 comprises at least two movable pads 15 on two mutually opposite faces thereof.

The possibility is not excluded of providing a lock 1 that has a plurality of substantially aligned ducts 7 in order to increase security against break-ins.

In this case, the key has a plurality of movable pads 15, at least one of which is provided with a depression 16 in its head 14.

Efficiently, the present invention solves the problems described earlier, proposing a cylinder lock 1 that is complicated to break into. This is due to the presence of the pad 15 provided with the depression 16 whose shape and dimensions are complementary to those of the terminal front of the second end 13 of the respective pin 10 of the lock 1.

Usefully, it is noted that the key 2 is difficult to emulate and therefore more secure than keys of the known type.

Advantageously, the cylinder lock 1, being associated with the corresponding key 2, is difficult to attack with break-in methods of the known type.

Conveniently, the cylinder lock 1 and the associated key 2 have substantially low costs and are relatively simple to provide in practice and safe in application.

The invention thus conceived is susceptible of numerous modifications and variations, all of which are within the scope of the appended claims. All the details may further be replaced with other technically equivalent elements.

In the exemplary embodiments shown, individual characteristics, given in relation to specific examples, may actually be interchanged with other different characteristics that exist in other exemplary embodiments.

In practice, the materials used, as well as the dimensions, may be any according to requirements and to the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A system, comprising:

a key including:

an elongated body having an outer surface;

a recess formed in the outer surface; and a movable pad disposed in the recess, the movable pad including a head with a depression and a base extending outwardly from the head, the base retaining the head within the recess; and a cylinder lock comprising:

a fixed body having a cavity defined therein; and a plug rotatably mounted in the cavity, wherein the plug includes a keyway operable to receive the elongated body of the key;

an auxiliary duct formed at least partially in the plug and facing the keyway; and a coding unit slidably seated in the auxiliary duct;

wherein the coding unit comprises:

a conical portion defining an internal cavity;

a pin comprising a first end and an opposite second end; and an axially acting elastic member interposed between the pin and the conical portion;

wherein the first end of the pin is received in the internal cavity such that the conical portion is mounted to the first end of the pin; and wherein the second end of the pin faces the keyway and tapers toward a terminal face having a shape that is complementary to that of the depression in order to accommodate the second end in the depression when the key is inserted into the keyway.

2. The system of claim 1, wherein the pin further comprises a central portion positioned between the first end and the second end; and wherein the central portion has a thickness corresponding to a diameter of the auxiliary duct.

3. The system of claim 1, wherein the key comprises a plurality of the movable pads; wherein the cylinder lock comprises a plurality of the auxiliary ducts and a plurality of the coding units;

wherein each coding unit is received in a corresponding one of the auxiliary ducts; and wherein the movable pads and the coding units are spaced such that when the key is fully inserted into the keyway, the terminal face of each pin is engaged with the depression of a corresponding one of the movable pads.

4. The system of claim 3, wherein each auxiliary duct comprises a large-diameter portion, a thinner portion, and a terminal recess;

wherein the large-diameter portion is formed in the plug and is arranged proximate to the outer surface of the plug that faces the body;

wherein the thinner portion is formed in the plug and is provided with at least one shoulder for a rim that protrudes from the pin of the corresponding coding unit; and wherein the terminal recess is provided in the body and is delimited by two mutually opposite and complementarily inclined surfaces.

5. The system of claim 1, wherein the cylinder lock includes two of the auxiliary ducts and two of the coding units;

wherein the two auxiliary ducts are positioned opposite one another;

wherein each of coding units is seated in a corresponding one of the auxiliary ducts; and wherein for each of the two coding units, the second end of the pin of the coding unit leads to the keyway and abuts against the corresponding movable pad when the key is inserted into the keyway.

6. The system of claim 1, wherein the axially acting elastic member comprises a compression spring.

7. The system of claim 1, wherein the depression comprises a tapered concavity.

8. The system of claim 7, wherein the tapered concavity extends into the base.

9. The system of claim 1, wherein the base retains the head within the recess below the outer surface of the elongated body.

10. A key, comprising:

a grip portion;

an elongated body extending from the grip portion and having an outer surface, and a plurality of coding grooves formed in the outer surface, wherein the elongated body comprises:

an accommodation recess;

a movable pad seated in the accommodation recess and defining an outward-facing concave depression, wherein a base of the movable pad retains the movable pad within the accommodation recess; and a biasing member urging the movable pad into contact with a rim of the accommodation recess, wherein the biasing member is engaged between a bottom of the recess and the base of the movable pad.

11. The key of claim 10, wherein the base of the movable pad comprises a centering protrusion that is received within the biasing member.

12. The key of claim 10, wherein the elongated body comprises a second of the accommodation recess;

wherein the accommodation recess and the second accommodation recess are positioned on opposite sides of the elongated body;

wherein the key further comprises a second of the movable pad; and wherein the second movable pad is seated in the second accommodation recess.

13. The key of claim 10, wherein the key is configured for use with a cylinder lock including a coding unit; and wherein the concave depression is complementary in size and shape to an outermost front of the coding unit of the cylinder lock such that the depression is operable to at least partially receive the outermost front of the coding unit when the key is inserted into the cylinder lock.

14. The key of claim 10, wherein the elongated body comprises a plurality of the accommodation recesses; wherein the key comprises a plurality of the movable pads; and wherein each movable pad is seated in a corresponding one of the accommodation recesses.

15. The key of claim 10, wherein the concave depression is tapered.

16. The key of claim 10, further comprising a sleeve seated in the accommodation recess and defining the rim of the accommodation recess.

17. The key of claim 10, wherein the concave depression is formed in a head of the movable pad; and wherein the base of the movable pad extends outwardly from the head to retain the head within the accommodation recess below the outer surface of the elongated body of the key.

18. The key of claim 10, wherein the concave depression extends into the base.

19. A system including the key of claim 10, the system further comprising:

a cylinder lock including a keyway; and a coding unit having an outermost front received in the keyway; and wherein the outermost front has a shape and dimensions that are complementary to those of the depression such that the outermost front of the coding unit is seated in the depression when the key is inserted into the keyway.

20. A key, comprising:

a grip portion;

an elongated body extending from the grip portion and having an outer surface, and a plurality of coding grooves formed in the outer surface, wherein the elongated body comprises:

an accommodation recess defined in part by a first sleeve and a second sleeve, each sleeve having a corresponding and respective rim;

a movable pad seated in the accommodation recess and defining an outward-facing concave depression, wherein a base of the movable pad retains the movable pad within the accommodation recess;

a biasing member urging the movable pad into contact with the rim of the first sleeve; and a second of the movable pad;

wherein the second movable pad is seated in the accommodation recess; and wherein the biasing member is captured between the movable pad and the second movable pad and urges the second movable pad into contact with the rim of the second sleeve.

* * * * *